US005887292A

United States Patent [19]

Goren

[11] Patent Number: 5,887,292

[45] Date of Patent: Mar. 30, 1999

[54] DUAL FLUSH TOILET SYSTEM

[76] Inventor: Patrick Philip Goren, P.O. Box 812, Bisbee, Ariz. 85603

[21] Appl. No.: 108,811

[22] Filed: Jul. 1, 1998

[51] Int. Cl.[6] ..... E03D 1/22

[52] U.S. Cl. ..... 4/363; 4/326

[58] Field of Search ..... 4/326, 327, 363, 4/364, 365, 324, 415

[56] References Cited

U.S. PATENT DOCUMENTS

| | | | |
|---|---|---|---|
| 3,487,476 | 1/1970 | Stiern et al. | 4/326 |
| 3,719,958 | 3/1973 | Wilhelm . | |
| 3,820,170 | 6/1974 | Kern et al. . | |
| 3,842,444 | 10/1974 | Gruenhagen . | |
| 3,995,327 | 12/1976 | Hendrick . | |
| 4,143,430 | 3/1979 | Joshi et al. | 4/324 |
| 4,172,299 | 10/1979 | del Pozo | 4/326 |
| 4,399,835 | 8/1983 | Holderith | 137/414 |
| 5,111,537 | 5/1992 | Zaruba | 4/324 |
| 5,175,893 | 1/1993 | Navarrete | 4/326 |

*Primary Examiner*—Charles E. Phillips
*Attorney, Agent, or Firm*—LaValle D. Ptak

[57] ABSTRACT

A flush control system, for releasing different amounts of water from the holding tank of a toilet into a discharge pipe, includes an auxiliary tank mounted in the toilet holding tank. The auxiliary tank has a volume which is less than the volume of the holding tank, and has one end wall assembly with a flapper valve communicating with the interior of the auxiliary tank and another flapper valve in a different wall communicating with the interior wall of the holding tank. A chamber is formed between the two walls in which the flapper valves are located. The bottom of this chamber has an opening which is placed over the discharge pipe opening in the bottom of the holding tank. A balancing aperture is formed through one of the other walls of the holding tank to permit water flow to take place between the auxiliary tank and the holding tank. The balancing aperture is smaller in diameter than the diameter of the openings closed by the flapper valves; so that a low volume flush is effected when the flapper valve inside the auxiliary tank is opened, and a maximum flush is effected when the flapper valve located in the wall communicating with the holding tank is opened.

19 Claims, 1 Drawing Sheet

DUAL FLUSH TOILET SYSTEM

BACKGROUND

Flush toilets are in widespread use throughout the world for disposing of both fluid and solid waste. The standard construction for such toilets is to provide a holding tank for the water to be used in a flush,from which the water is fully discharged each time the toilet is flushed. The amount of water in the holding tank is selected to be sufficient to dispose of solid waste deposited into the toilet bowl. This requires a relatively large quantity of water. For disposal of fluid waste only, however, utilizing the full contents of the holding tank is wasteful, since fluid wastes can be disposed of with a much lower volume of water.

In many areas of the world, such as in the Southwestern United States, water is in short supply. Efforts to conserve water include efforts to reduce the amount of water consumed in a flush toilet each time the flush mechanism is operated. Some of these efforts simply employ devices for limiting the amount of water in the tank; so that a lower volume of water is used each time the toilet is flushed. Approaches of this nature, however, frequently result in unsatisfactory disposal of solid waste, since often it is necessary to flush such a low water volume toilet more than once in order to dispose of solid wastes. This defeats the purpose of the low volume. Such toilets generally do not have any problem in disposing of purely liquid waste.

In efforts to alleviate the problems associated with simply reducing the water level every time a toilet is flushed, dual flush toilet devices have been designed. These toilets are selectively operated to use the full volume water available for solid waste disposal, and to use a lesser volume of water for liquid waste disposal.

Two United States patents, Pozo U.S. Pat. No. 4,172,299 and Navarrette U.S. Pat. No. 5,175,893, disclose dual flush mechanisms. In the devices of both of these patents, flush valves are located at different heights on a discharge pipe inside the toilet tank. One of these valves is located near the bottom of the holding tank; and the other valve is located at an intermediate position above the other or first of the valves. When a full flush is desired, the flapper valve located at the lowermost position is operated to discharge the full volume of water into the toilet bowl for effecting flushing of solid waste. When a partial flush, for disposing of fluid waste only, is desired, the upper flapper valve is opened. Thus, less water is required to effect a flush, since the upper valve closes before the water level in the tank drops to the bottom of the tank. The pressure available for effecting a partial flush, however, is less than the pressure available for the full flush because of the location of the partial flush valve at a higher position within the tank. As a consequence, the flushing action which takes place in the toilet bowl is not as vigorous for a partial flush as it is for a full flush because of this reduced pressure.

Another approach to providing reduced volume water flushes in a toilet tank is disclosed in the U.S. patent to Kern U.S. Pat. No. 3,820,170. This patent is directed to a modification of a standard toilet tank to permit it to provide only reduced water flushes. This is not a dual flush device. The device of this patent utilizes a smaller container or barrier in the tank around the discharge pipe; so that when the flush mechanism is operated, only the water which is above the top of this container or barrier, and then located within the barrier, is used to effect the flush. This leaves the remainder of the water in the tank surrounding the barrier unused. This patent is directed to an installation which is to be made to an existing toilet tank to reduce the amount of water available for a flush operation.

An after-market installation for effecting a dual flush operation is disclosed in the U.S. patent to Gruenhagen U.S. Pat. No. 3,842,444. This patent discloses a closed compartment which is placed in the toilet over the exhaust or discharge pipe in the bottom of the holding tank. The compartment then surrounds the valve which normally is associated with the discharge pipe. The compartment is hinged at one side, and is magnetically held in place at the other side. Thus, some very specific installation requirements must be made in order to place this device in an existing toilet holding tank. When a partial flush is desired, operation of a lever lifts the stopper from the exhaust pipe in the chamber. The water in the chamber is used to effect the partial flush. Water in the remainder of the tank surrounding the chamber is not used for such a low volume flush operation. When a full volume flush is desired, the valve in the chamber first is lifted; then further operation of the handle or operating lever lifts the entire inner tank up on the edge opposite the hinge to permit the water to flow under that edge and through the discharge or exhaust pipe. Thus, the entire contents of the tank are emptied for such a full flush. At the end of the full flush, the tank drops back into place and is held against the bottom of the toilet holding tank by the magnet. The flapper valve within the inner tank also closes in a normal manner. This is a relatively complex device.

The United States patent to Zaruba U.S. Pat. No. 5,111,537 discloses several versions of a dual flush toilet. Some of these versions include a pair of flapper valves located at different heights within the tank to effect the flushing, but in the manner described previously in conjunction with the Pozo and Navarrette patents. FIG. 9 of this patent, however, shows a dual flush version which uses an auxiliary inner tank surrounding the exhaust pipe or discharge pipe in the holding tank. This auxiliary inner tank has a valve located in the bottom of it, much like the one in the Gruenhagen patent discussed above. In addition, there is a flapper valve located in the side of this tank. For a partial flush, the original or inner valve is opened and only the water in the inner tank is discharged. When a full flush is desired, the two valves both are opened to permit water in the tank to flow from the main tank through the opening in the side of the auxiliary tank, and then out through the discharge pipe in the bottom of the holding tank.

The U.S. patent to Wilhelm U.S. Pat. No. 3,719,958 is a custom or factory made toilet tank for effecting a dual flush operation. This is not a device which may be added to a standard toilet holding tank originally designed for a single flush operation. In the device of Wilhelm, two different discharge openings are provided in the bottom of the tank. A separate standpipe is formed around one of these openings to effect a partial flush, where only the water within this standpipe is discharged. For a full flush, both of the stoppers or valves are raised; so that the water within the standpipe as well as the water within the main tank is used to effect the flush.

It is desirable to provide an improved dual flush control system for releasing different amounts of water from the holding tank of a toilet into a discharge pipe opening in the bottom of the holding tank, which overcomes the disadvantages of the prior art, which is simple in construction, easy to install and simple to operate.

SUMMARY OF THE INVENTION

It is an object of this invention to provide an improved flush valve assembly for a toilet tank.

It is another object of this invention to provide an improved dual flush valve assembly for a toilet holding tank.

It is a further object of this invention to provide an improved dual flush control system for the holding tank of a toilet which may be installed in an existing conventional toilet tank.

It is another object of this invention to provide an improved dual flush toilet tank device which may be adapted for a standard toilet tank and which is simple to install and simple to operate.

In accordance with a preferred embodiment of the invention, a dual flush control system for releasing different amounts of water from the holding tank of a toilet into a discharge pipe opening in the bottom of the holding tank includes an auxiliary tank installed into the holding tank. The auxiliary tank has a volume less than the volume of the holding tank; and it is placed within the holding tank. The auxiliary tank has a bottom, first and second sides, a first end wall and a second end wall assembly which includes first and second spaced valve plates which form a chamber between them. The bottom of the chamber has an opening in it which is placed over the pipe opening in the bottom of the toilet holding tank. A first valve is located in a hole in the first valve plate to control water flow from the auxiliary tank to the pipe opening. A second valve is placed in a hole in the second valve plate to control water flow from the toilet holding tank to the pipe opening. A balance aperture is located in the auxiliary tank to permit an exchange of water flow to and from the auxiliary tank at a rate which is less than the water flow through either of the openings in the valve plates. A control device is provided to selectively open the first and second valves.

DETAILED DESCRIPTION

Figure 1:
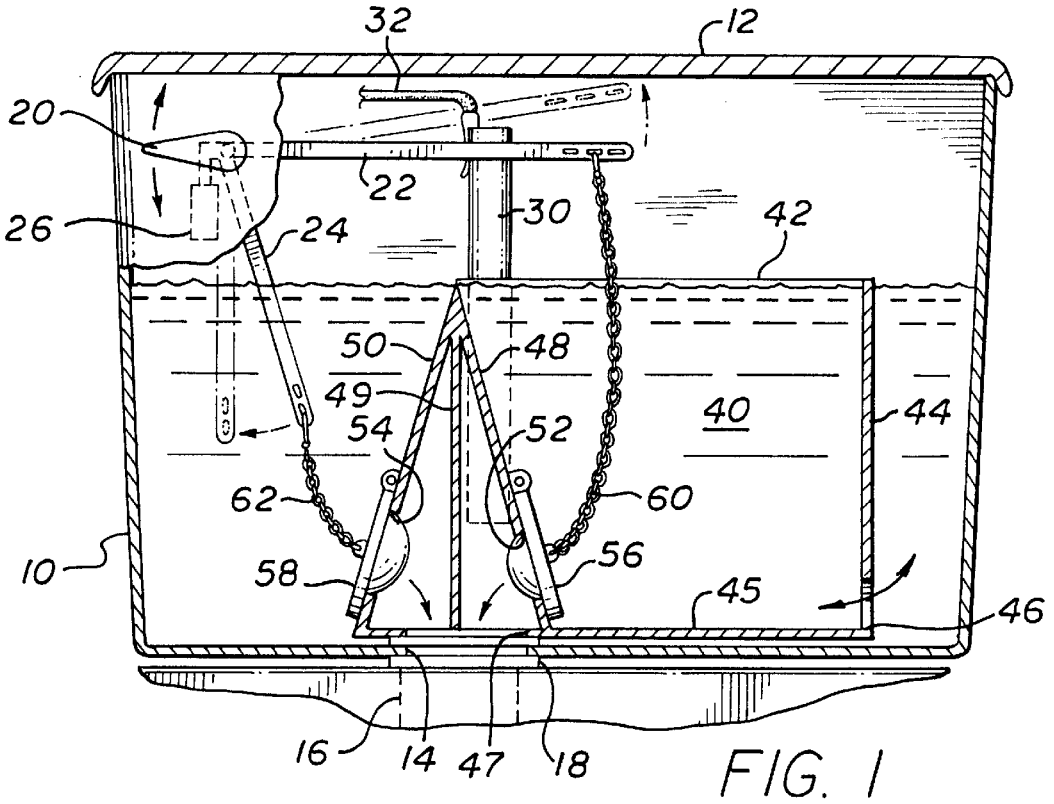
FIG. 1 is a cross-sectional view of a preferred embodiment of the invention.

Reference now should be made to the drawing, in which the same reference numbers are used throughout the different figures to designate the same components. FIG. 1 is a cross-sectional view of the installation of a preferred embodiment of the invention in a standard toilet holding tank 10. The toilet tank 10, shown in cross section in FIG. 1, is a conventional tank with a bottom and first and second end walls and first and second side walls. A removable top 12 is placed over the holding tank in a conventional manner.

It is well known that the holding tank 10 has a generally elongated rectangular configuration for cross sections taken in horizontal planes between the bottom of the tank and the top 12. For that reason, end views and top views of the tank 10 are not shown, since it is conventional in all respects.

At the bottom of the tank 10, a discharge pipe opening 14 is provided for enabling the discharge of water located in the tank to be effected through the opening 14 into a discharge pipe 16, which then is connected to a toilet bowl forming the other portion of the toilet assembly with which the tank 10 is associated. Typically, a rubber gasket 18 is used to seal the opening 14 and the top of the pipe 16, which also may be threaded into a fitting located in the opening 14. The manner in which a watertight seal between the opening 14 and the pipe 16 is effected is standard; and for that reason, no details of this interconnection are shown in the drawing.

Figure 2:
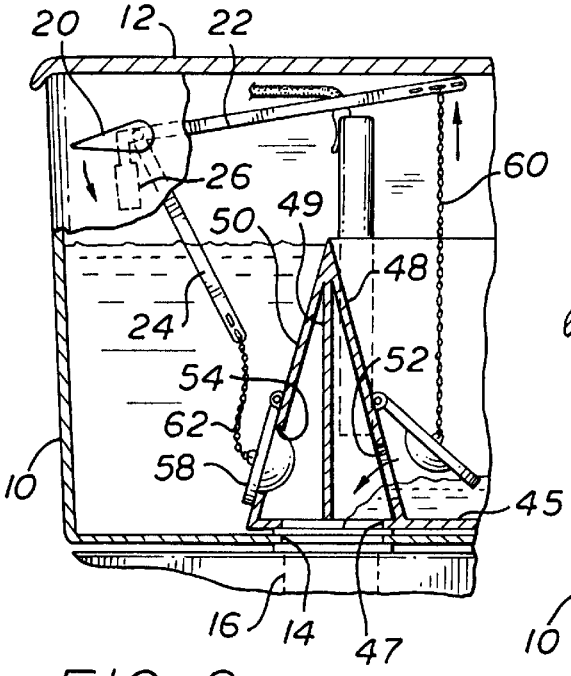
FIG. 2 is a partial cross-sectional view of the embodiment shown in FIG. 1 showing a first mode of operation.
Figure 3:
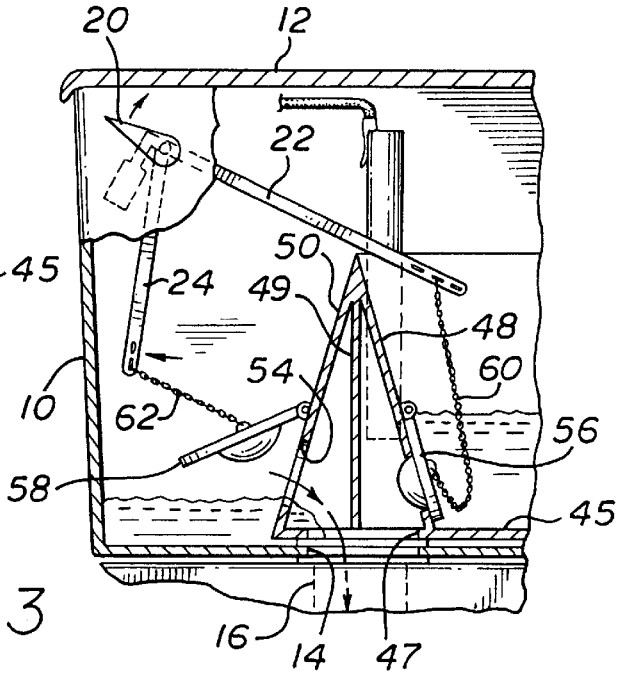
FIG. 3 is a partial cross-sectional view of the embodiment shown in FIG. 1 showing a different mode of operation from that shown in FIG. 2.

Normally, a flapper valve is placed to cover the opening 14 in the bottom of the tank 10; and this valve then is opened whenever the flushing of the toilet is to be effected. Without the addition of the preferred embodiment of the invention which is shown in FIGS. 1, 2 and 3, the entire contents of the tank of FIG. 1 then would be discharged through the opening 14 into the pipe 16 in a normal manner. The mechanism for refilling the tank 10 is illustrated only diagrammatically through the stand pipe 30 and a fill line 32. Once again, the valves for controlling the filling of the tank 10 after a flush has been effected are not shown, since standard mechanisms are employed. These mechanisms are not altered by the addition of the components for the preferred embodiment of the invention.

To convert the conventional single-flush toilet tank 10 described above in conjunction with FIG. 1 into a dual-flush toilet, an auxiliary tank 40 having a bottom 45 and an open top is placed in the position shown in FIG. 1. This auxiliary tank has a pair of front and back sidewalls, the back sidewall 42 of which is shown (the front sidewall which is not shown is parallel to and spaced from the sidewall 42 and identical to it). These sidewalls are separated by a first end wall 44 shown at the right-hand end of the auxiliary tank 40, and a second end wall assembly. The second end wall assembly includes a vertical plate 49 which is similar to the end wall 44, and a pair of sloped end wall valve plates 48 and 50, which are joined together at the upper ends with the vertical wall 49 between the front and back sidewalls.

As is readily apparent from an examination of FIG. 1, the internal volume of the tank 40 is less than the full available volume of the toilet holding tank 10. In the example shown in FIG. 1, it should be noted that the spacing of the side walls, such as the rear sidewall 42 which is shown (and the front sidewall which is identical to it), from the front and back walls of the tank 10 is such that water in the tank 10 is located on all four sides of the auxiliary tank 40.

When the auxiliary tank 40 is positioned as shown in FIG. 1, the chamber which is formed between the sloped valve plate walls 48 and 50 (bifurcated by the vertical wall 49) is located over the pipe opening 14 in the bottom of the holding tank 10. A corresponding threaded pipe opening 47 is formed in the bottom 45 of this chamber in alignment with the opening 14. This threaded pipe opening may include a spacer (not shown) to hold the bottom 45 a slight distance above the bottom of the tank 10. A threaded extension (not shown) also may extend downwardly through the opening 14, if desired. The lower ends of the valve plate walls 48 and 50 are on opposite sides of the opening 14; so that the chamber between the walls 48 and 50 is fully enclosed on the front and back sides by the sidewalls 42 and the front sidewall (not shown) to prevent any water from entering this chamber so long as the device is in the standby configuration shown in FIG. 1.

As shown in FIG. 1, there is a balance aperture or hole 46 located near the bottom edge of the end plate 44 to permit water to flow back-and-forth in the direction of the double-ended arrow into and out of the auxiliary tank 40 in the manner to be described subsequently. When the toilet is in its standby condition of operation, as shown in FIG. 1, the water level in the tank is controlled by the normal control mechanism, and is illustrated as generally above the level of the upper edge of the end wall 44 and the sidewall 42. The balance aperture 46 ensures that the water levels inside the auxiliary tank 40 and outside of the tank 40 within the main toilet holding tank 10 attain an equilibrium level, as indicated in FIG. 1.

When a low volume flush of the toilet with which the device of FIG. 1 is associated is desired, an operating lever 20 on the outside of the tank 10 is pushed down or rotated in a normal manner. This causes an operating arm extension 22 to pivot in a counterclockwise direction, as shown in both FIGS. 1 and 2, to engage a pull chain 60. The chain 60 pivots a standard flapper valve 56 out of its closed position in a hole 52 in the valve plate 48 to open the hole 52. This allows water located within the auxiliary tank 40 to be discharged into the opening 14 under the lower edge of the plate 49, as illustrated in FIG. 2. The operation of the handle 20 is a momentary operation. When it is released, a weight 26 causes the mechanism to reach the equilibrium position shown in solid lines in FIG. 1. As is well known, the chain 60 permits the flapper valve 56 to close when the water level reaches the point generally illustrated in FIG. 2 to thereby ready the system for the next flush. Because the diameter (and, therefore, the area) of the opening 52 is substantially greater than the diameter of the balance hole 48, the discharge of water from the holding tank 40 effectively takes place rapidly, with very little additional water flow taking place into the tank 40 through the balance hole 46 during this reduced flush operation. The valve 56 closes prior to the discharge of any substantial amount of water from the region of the tank 10 surrounding the auxiliary tank 40. Thus, a reduced water flow flush takes place whenever the lever 20 is pressed downward in the direction of the arrows shown in FIGS. 1 and 2.

When a full or higher volume flush operation is desired, the lever 20 is pivoted clockwise or upwards, as shown in FIG. 3. This causes further slack to be produced in the chain 60; so that the valve 56 located within the auxiliary tank 40 remains closed. The valve 58 located in a hole 54 in the plate 50 is opened by means of a lever arm 26, which pulls the chain 62 taut to lift the flapper valve 58 in a conventional manner. This allows water in the main tank 10 to flow through the hole 54 and the discharge pipe opening 14 underneath the plate 49, as illustrated in FIG. 3. At the same time, at least some of the water located in the auxiliary tank 40 flows out of the auxiliary tank 40 into the region surrounding the tank 40 through the balance aperture 46 to be utilized in conjunction with this full flush operation of the flush system.

Since the flapper valves 56 and 58 are both located near the lower ends of the valve plates 48 and 50, the pressure which is available for effecting either a low volume flush or a high volume flush is identical at the beginning of each of the flush operations. The plate 49 serves to prevent any flow or turbulence of water in the chamber formed between the valve plates 48 and 50 as a result of opening one or the other of the valves 56 or 58 from pushing open the opposite closed valve (56 or 58) when the discharge is taking place. Thus, the valve 58 remains closed during a partial flush operation of the type shown in FIG. 2; and the valve 56 remains closed during a full flush operation of the type illustrated in FIG. 3.

The operation of the flush valves and the mechanism under control of the momentary operation of the lever 20 to either of the positions shown in FIGS. 2 and 3 is standard in every way. Thus, the operator of the toilet needs only to understand that instead of only a single direction of motion of the type normally used with a full flush toilet having a single mode of operation, the lever 20 may be moved in either of two directions to effect the desired full or partial flush, as desired. If the operator mistakenly moves the lever in the direction of a partial flush when a full flush is desired, immediately moving the lever in the other direction will still result in a full flush. When the device is in its standby condition between flushes, the water pressure on the reverse sides of the flappers 56 and 58 holds them tightly closed against the holes 52 and 54 in the valve plates in a standard or conventional manner.

The foregoing description of the preferred embodiment of the invention is to be considered as illustrative and not as limiting. Various changes and modifications will occur to those skilled in the art for performing substantially the same function, in substantially the same way, to achieve substantially the same result, without departing from the true scope of the invention as defined in the appended claims. For example, the balance aperture 46 could be located in the front or back sidewalls instead of in the end wall 44.

What is claimed is:

1. A flush control system for releasing different amounts of water from the holding tank of a toilet into a discharge pipe opening in the bottom of the holding tank, said system including in combination:

an auxiliary tank having a volume less than the volume of said holding tank for placement within said holding tank, said auxiliary tank having first and second sides, a first end wall and a second end wall assembly including first and second spaced valve plates forming a chamber therebetween, said chamber having an opening placed over said discharge pipe opening in said holding tank with a balance aperture through one of said sides and said first end wall communicating with the interior of said holding tank;

a first valve located in a hole in said first valve plate to control water flow from said auxiliary tank to said discharge pipe opening;

a second valve in a hole in said second valve plate to control water flow from said holding tank to said discharge pipe opening; and a control device selectively opening said first and second valves.

2. The combination according to claim 1 wherein said auxiliary tank has an open top, with said first and second sides, said first end wall and said second end wall assembly each having a vertical height which is less than the internal vertical height of said holding tank.

3. The combination according to claim 2 wherein said balance aperture in the first end wall of said auxiliary tank is located near the bottom of said first end wall.

4. The combination according to claim 3 wherein the cross-sectional area of the balance aperture in said first end wall is less than the cross-sectional area of each of the respective holes in said first and second valve plates.

5. The combination according to claim 4 wherein said control device includes an operating handle rotated in one direction to open said first valve and rotated in an opposite direction to open said second valve.

6. The combination according to claim 5 wherein said first and second valve plates each have a bottom located adjacent the bottom of said holding tank when said auxiliary tank is in place therein, and wherein the holes in said first and second valve plates are located near the bottoms of said first and second valve plates.

7. The combination according to claim 6 wherein said first and second valves are flapper valves which automatically close after water flow therethrough is reduced to a predetermined amount.

8. The combination according to claim 4 wherein said control device includes a pivotal handle having first and second lever arms attached thereto, with said first lever arm coupled with said first valve and said second lever arm coupled with said second valve, whereupon pivoting said handle in one direction causes said first lever arm to open said first valve and pivoting said handle in a second direction causes said second lever arm to open said second valve.

9. The combination according to claim 8 wherein said first and second valve plates each have a bottom located adjacent the bottom of said holding tank when said auxiliary tank is in place therein, and wherein the holes in said first and second valve plates are located near the bottoms of said first and second valve plates.

10. The combination according to claim 9 wherein said first and second valves are flapper valves which automatically close after water flow therethrough is reduced to a predetermined amount.

11. The combination according to claim 1 wherein said auxiliary tank has a bottom designed to rest slightly above the bottom of said holding tank.

12. The combination according to claim 1 wherein said control device includes an operating handle rotated in one direction to open said first valve and rotated in an opposite direction to open said second valve.

13. The combination according to claim 12 wherein said first and second valve plates each have a bottom located adjacent the bottom of said holding tank when said auxiliary tank is in place therein, and wherein the holes in said first and second valve plates are located near the bottoms of said first and second valve plates.

14. The combination according to claim 13 wherein said balance aperture in the first end wall of said auxiliary tank is located near the bottom of said first end wall.

15. The combination according to claim 1 wherein said first and second valve plates each have a bottom located adjacent the bottom of said holding tank when said auxiliary tank is in place therein, and wherein the holes in said first and second valve plates are located near the bottoms of said first and second valve plates.

16. The combination according to claim 1 wherein said balance aperture in the first end wall of said auxiliary tank is located near the bottom of said first end wall.

17. The combination according to claim 1 wherein the cross-sectional area of the balance aperture in said first end wall is less than the cross-sectional area of each of the respective holes in said first and second valve plates.

18. The combination according to claim 1 wherein said control device includes a pivotal handle having first and second lever arms attached thereto, with said first lever arm coupled with said first valve and said second lever arm coupled with said second valve, whereupon pivoting said handle in one direction causes said first lever arm to open said first valve and pivoting said handle in a second direction causes said second lever arm to open said second valve.

19. The combination according to claim 1 wherein said first and second valves are flapper valves which automatically close after water flow therethrough is reduced to a predetermined amount.

* * * * *